United States Patent [19]

Swisher, Jr. et al.

[11] 4,185,875

[45] Jan. 29, 1980

[54] ASPHALT CRUSHING APPARATUS

[75] Inventors: George W. Swisher, Jr.; Thomas L. Steele, both of Oklahoma City, Okla.

[73] Assignee: CMI Corporation, Oklahoma City, Okla.

[21] Appl. No.: 948,389

[22] Filed: Oct. 4, 1978

[51] Int. Cl.[2] ..... E01C 23/08

[52] U.S. Cl. ..... 299/39; 299/18; 404/91; 241/101.7

[58] Field of Search ..... 299/39, 41, 18; 404/90, 404/91

[56] References Cited

U.S. PATENT DOCUMENTS

| | | | |
|---|---|---|---|
| 2,368,331 | 1/1945 | Seaman | 299/39 X |
| 2,905,456 | 9/1959 | Rafferty et al. | 299/39 |
| 3,510,073 | 5/1970 | Mailliard | 404/91 X |
| 3,843,274 | 10/1974 | Gutman et al. | 404/91 |
| 4,139,318 | 2/1979 | Jakob et al. | 299/39 X |

FOREIGN PATENT DOCUMENTS 505767 3/1976 U.S.S.R.

*Primary Examiner*—Ernest R. Purser
*Attorney, Agent, or Firm*—Dunlap, Codding & McCarthy

[57] ABSTRACT

An apparatus for crushing fragments of asphalt removed from a roadway by a paved roadway planing apparatus includes a grid upon which the fragments are deposited and a crushing tool having a plurality of cutting bits mounted on a rotating drum for movement along circular paths intersecting the grid. The crushing apparatus can be towed behind the paved roadway planing apparatus to receive the asphalt removed from the roadway from the paved roadway planing apparatus and to redeposit the crushed fragments on the roadway.

10 Claims, 18 Drawing Figures

ASPHALT CRUSHING APPARATUS

CROSS-REFERENCE TO RELATED APPLICATION

The subject matter of the present invention is related to the subject matter of co-pending United States patent application entitled "A Method and Apparatus for Planing a Paved Roadway", Ser. No. 672,326, now Patent No. 4,139,318 filed Mar. 31, 1976, by Herbert Edward Jacob and Richard A. Silbernagel and assigned to the Assignee of the present invention.

BACKGROUND OF THE INVENTION

1. Field of the Invention

This invention relates generally to highway construction machinery and, more particularly, but not by way of limitation, to machinery for crushing asphalt removed from paved roadways for reuse of such asphalt.

2. Description of the Prior Art

Machines for planing the surface of a paved roadway are known in the art. For example, an apparatus suitable for planing asphalt from a paved roadway is disclosed in the aforementioned co-pending United States Patent Application, Ser. No. 672,326. It is also known to crush material removed from a roadway and to redeposit such material on the roadway. Machines constructed for this purpose have been disclosed in United States Pat. No. 1,938,755, issued to Swearingen on Dec. 12, 1933, and in Russian Authors Certificate No. 505,767 issued to Samuilov, et al., publication date Mar. 5, 1976.

A problem which occurs when asphalt removed from a roadway is redeposited is that the apparatus for planing the roadway can produce large fragments of asphalt which are not suitable for reuse in resurfacing the roadway.

SUMMARY OF THE INVENTION

The present invention contemplates an asphalt crushing apparatus which is towed behind a roadway planing apparatus and which receives large fragments of asphalt from a conveyor forming a portion of the roadway planing apparatus. The asphalt crushing apparatus includes a grid upon which the fragments of asphalt are deposited and a crushing tool which breaks the fragments into small pieces which fall through the grid and are redeposited upon the roadway.

The crushing tool comprises a rotating drum having a plurality of cutting bits mounted thereon for movement along circular paths which intersect the grid and which engage the asphalt fragments to reduce the fragments to small pieces. The cutting bits are mounted on the drum via holders welded to the drum and the cutting bits and holders are constructed such that the cutting bits can be removed and replaced after the cutting bits have become worn. The crushing tool is made accessible to workmen for replacement of the bits by pivotally mounting the rear end of the grid of the chassis of the apparatus and securing a medial portion of the grid to the chassis via removable pins. A winch is provided to aise and lower the forward end of the grid.

The forward end of the asphalt crushing apparatus is supported at two points on the roadway planing apparatus and wheels supporting the rear end of the chassis are mounted on a walking beam to maintain the chassis transversely parallel to the roadway planer.

An object of the invention is to provide an apparatus for reducing large fragments of asphalt removed from a roadway to small pieces suitable for reuse in surfacing the roadway.

Another object of the invention is to provide an apparatus for reducing fragments of asphalt removed from a roadway which may be towed by an apparatus for removing asphalt from the roadway.

Other objects and advantages of the invention will be evident from the following detailed description when read in conjunction with the accompanying drawings which illustrate preferred embodiments of the invention.

BRIEF DESCRIPTION OF THE DRAWINGS

FIG. 6 is a front elevational view of the asphalt crushing apparatus of FIG. 1 with the grid in the lowered position thereof.

DESCRIPTION OF FIGS. 1 THROUGH 11

Figure 1:
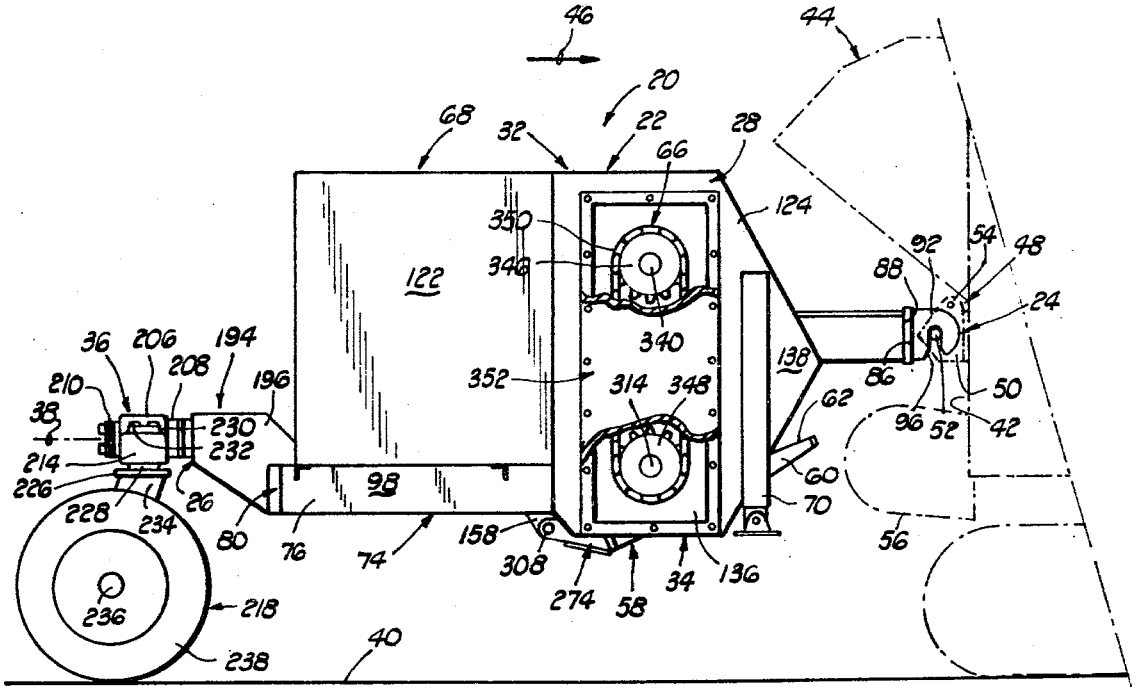
FIG. 1 is a first side elevational view in partial cutaway of an asphalt crushing apparatus constructed in accordance with the present invention, showing the towing of the apparatus by an asphalt planer.
Figure 2:
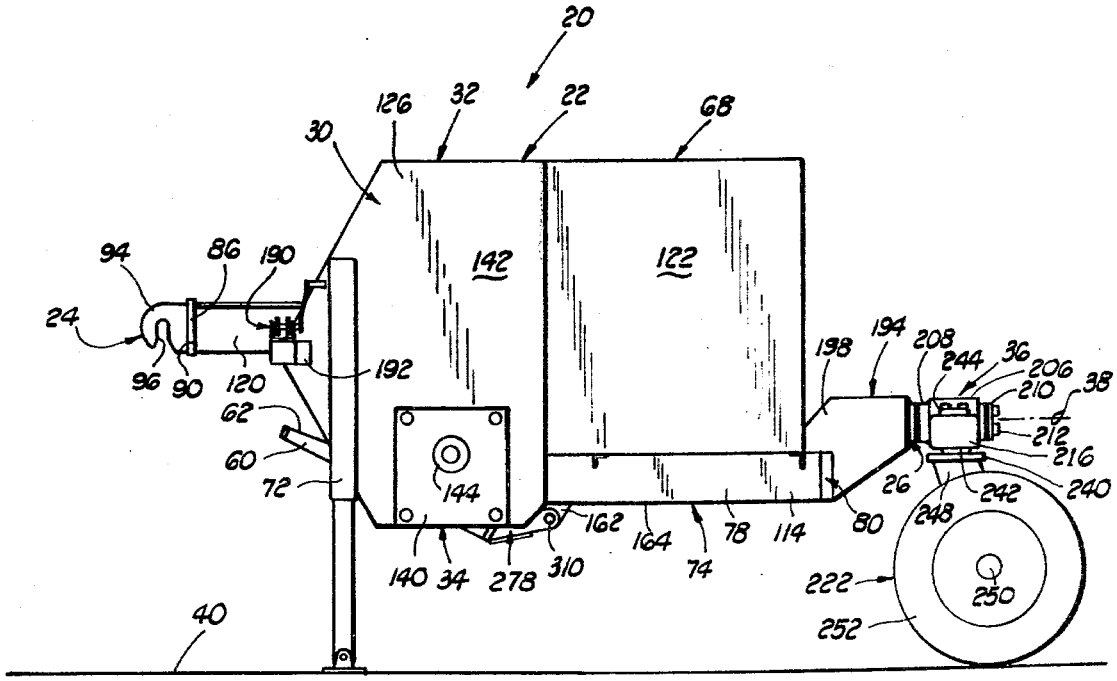
FIG. 2 is a second side elevational view of the asphalt crushing apparatus of FIG. 1.

Referring now to the drawings and to FIGS. 1 and 2 in particular, shown therein and designated by the general reference numeral 20 is an asphalt crushing apparatus constructed in accordance with the present invention. In a preferred operating mode of the asphalt crushing apparatus 20, the asphalt crushing apparatus 20 is placed in a towed mode wherein the asphalt crushing apparatus 20 is towed behind an apparatus 44 for planing a paved roadway. The apparatus 44 for planing a paved roadway is shown in phantom lines in FIG. 1 and will hereinafter be referred to as the roadway planer 44. The roadway planer 44 is constructed to move in a direction indicated by the arrow designated 46 in FIG.

1 along a roadway 40 and to remove a surface layer of asphalt from the roadway 40. The asphalt removed from the roadway 40 is discharged from the rear end 42 of the roadway planer 44 via a conveyor 56. A roadway planer 44 which is well suited for use with the asphalt crushing apparatus 20 has been disclosed in the aforementioned, co-pending United Stated patent application, Ser. No. 672,326.

The asphalt crushing apparatus 20 comprises a chassis 22 having a forward end 24, a rear end 26, a first side 28, a second side 30, a top 32 and a bottom 34. A wheel assembly 36 is pivotally connected to the rear end 26 of the chassis 22 for pivotation about the longitudinal axis 38 of the chassis 22. The wheel assembly 36 rollingly supports the asphalt crushing apparatus 20 at the rear end 26 of the chassis 22 and the roadway planer 44 supports the forward end 24 of the chassis 22 such that the axis of pivotation 38 is maintained substantially horizontal and extends substantially along the direction 46 of movement of the roadway planer 44.

In order to provide for attaching the asphalt crushing apparatus 20 to the roadway planer 44, two planer clevises are mounted on the rear end 42 of the roadway planer 44 in a spaced apart relation transversely to the direction 46 in which the roadway planer 44 moves. (Only one planer clevis, designated 48 in FIG. 1 has been illustrated.) The planer clevises are disposed along a substantially horizontal line on the rear end 42 of the roadway planer 44 and are vertically positioned thereon to maintain the axis 38 of the chassis 22 substantially horizontal in the towed mode of the asphalt crushing apparatus 20. Each planer clevis comprises a pair of spaced, parallel plates in the usual manner, and as will be discussed in more detail below, a portion of the chassis 22 is secured between each pair of plates in the towed mode of the asphalt crushing assembly 20. (One of the plates of the clevis 48, designated 50 in FIG. 1, has been illustrated. The other plate of the planer clevis 48 and the plates of the planer clevis not shown are identical to the plate 48.) An aperture 52 is formed through the central portion of each plate of each planer clevis and a smaller aperture 54 is formed through an upper portion of each such plate to permit the asphalt crushing assembly 20 to be secured to the roadway planer 44 as will be described below. Since the asphalt crushing apparatus 20 is secured to the roadway planer 44 at two positions on the rear end 42 of the roadway planer 44 and since the wheel assembly 36 is pivotally attached to the chassis 22 for pivotation about the longitudinal axis 38, the chassis 22 remains transversely parallel with the roadway planer 44 during operation of the roadway planer 44 and the asphalt crushing assembly 20.

As has been noted above, the roadway planer 44 is constructed to remove a layer of asphalt from the roadway 40 in a manner described in the aforementioned, co-pending United States patent application, Ser. No. 672,326, and the asphalt so removed is discharged through the rear end 42 of the roadway planer 44 via the conveyor 56. The chassis 22 of the asphalt crushing apparatus 20 is positioned with respect to the roadway planer 44 to receive asphalt fragments discharged by the roadway planer 44, reduce the size of the fragments exceeding a predetermined dimension, and redeposit the asphalt on the roadway 40. For this purpose, the asphalt crushing apparatus 20 comprises a crusher assembly 58 disposed in a medial portion of the chassis 22 for receiving the asphalt fragments discharged via the conveyor 56. In particular, the crusher assembly comprises a grid 60 positioned behind the conveyor 56 in the towed mode of the asphalt crushing apparatus 20 such that asphalt fragments removed from the roadway 40 are deposited on the grid 60. The grid 60, which will be described in more detail below with reference to FIGS. 7, 8 and 9, has an upper surface 62 which slopes downwardly and rearwardly at an angle of approximately 20 degrees with respect to the longitudinal axis 38 such that asphalt fragments deposited on the grid 60 gravitate toward the rear end 26 of the chassis 22. The crusher assembly 58 further comprises a rotating crushing tool 64 (see FIG. 4) which intersects the upper surface 62 of the grid 60 to engage and crush asphalt fragments supported by the upper surface 62 of the grid 60. The crushing tool 64 will be described in more detail below with reference to FIGS. 10 and 11.

The asphalt crushing apparatus 20 further comprises a hydraulically actuated drive assembly 66 for rotating the crushing tool 64 and a power assembly 68 for providing pressurized hydraulic fluid to the drive assembly 66. The power assembly 68 is of standard construction and need not be described for purposes of the present disclosure. It will suffice to note that the power assembly 68 generally comprises an internal combustion engine which drives a hydraulic pump in the usual manner to provide the pressurized hydraulic fluid for the drive assembly 66. The drive assembly 66 will be described in more detail below.

Extensible legs 70 and 72 are fixed to the sides 28 and 30 respectively of the chassis 22 for supporting the forward end 24 of the chassis 22 at such times that the asphalt crushing apparatus 20 is not attached to the roadway planer 44. The extensible legs 70 and 72 are of standard construction and need not be described for purposes of the present disclosure. It will suffice to note that the legs 70, 72 can be extended to provide support for the chassis 22 as illustrated for the leg 72 in FIG. 2 and can be retracted, as illustrated for the leg 70 in FIG. 1, such that the legs 70, 72 will not interfere with towing of the asphalt crushing apparatus 20 along the roadway 40.

The chassis 22 comprises a frame 74, the general form of which is particularly shown in FIGS. 1, 2, 3 and 4. The frame 74 comprises a first side beam 76 extending generally along the first side 28 of the chassis 22 and a second side beam 78, forming the mirror image of the first side beam 76 and extending along the second side 30 of the chassis 22 in a parallel relation with the first side beam 76. The frame 74 terminates in a rear end 80 near the rear end 26 of the chassis 22 and a rear cross beam 82 (FIG. 3) is connected to the side beams 76 and 78 at the rear end 80 of the frame 74 and extends therebetween transversely across the chassis 22 substantially perpendicularly to the side beams 76 and 78. A forward cross beam 84 (FIGS. 3 and 4) is connected to the side beams 76 and 78 in a medial portion of the chassis 22 and extends therebetween transversely across the chassis 22 substantially parallel to the rear cross beam 82. Near the forward end 24 of the chassis 22, a cross plate 86 is welded to the forward ends 88 and 90 (FIGS. 1 and 2) of the side beams 76 and 78 and extends transversely across the chassis 22. The cross beams 82, 84 and the cross plate 86 form the frame 74 into a rigid structure for supporting the crusher assembly 58, the drive assembly 66 and the power assembly 68.

A first planer connection lug 92 is welded to the cross plate 86 oppositely the first side beam 76 near the first side 28 of the chassis 22 and a second planer connection lug 94 is similarly welded to the cross plate 86 near the second side 30 of the chassis 22. The planer connection lugs 92 and 94 provide the means for connecting the asphalt crushing apparatus to the roadway planer 44 as will now be described. In particular, the planer connection lugs 92 and 94 are positioned in the planer clevises mounted on the rear end 42 of the roadway planer 44 in the towed mode of the asphalt crushing apparatus 20 such that each planer connection lug 92, 94 is disposed between the plates forming one of the planer clevises. Each planer connection lug 92, 94 has a downwardly opening slot 96 and pins (not shown), inserted through the apertures 52 of the plates of the planer clevises, engage the slots 96 in the planer connection lugs 92, 94 to support the forward end 24 of the chassis 22 on the rear end 42 of the roadway planer 44. Pins (not shown) inserted through the apertures 54 in the plates forming the planer clevises prevent disengagement between the slots 96 and the pins (not shown) passing through the apertures 52 of the planer clevises to secure the asphalt crushing apparatus 20 to the roadway planer 44. The use of the slots 96 and two pins to connect the asphalt crushing apparatus 20 to the roadway planer 44 is particularly advantageous in the case wherein the roadway planer 44 is provided with hydraulically actuated grade and cross slope controls as in the case of the roadway planer disclosed in the aforementioned, co-pending United States patent application, Ser. No. 672,326. Such controls permit the rear end 42 of the roadway planer 44 to be lowered and subsequently raised so that the asphalt crushing apparatus 20 is easily connected to the asphalt planer 44 in the following steps: (1) positioning the roadway planer 44 in front of the asphalt crushing apparatus 20 with the planer clevises, having pins inserted through the apertures 52 thereof, disposed below the planer connection lugs 92, 94; (2) raising the rear end 42 of the asphalt planer 44 to engage the pins passing through the apertures 52 of the planer clevises with the slots 96 in the planer connection lugs 92 and 94; (3) inserting pins through the apertures 54 in the planer clevises to secure the planer connection lugs 92, 94 to the planer clevises; and (4) retracting the extensible legs 70, 72 disposed on the sides 28 and 30 of the asphalt crushing apparatus 20.

As has been previously noted, the side beams 76 and 78 of the frame 74 are mirror images and are disposed in a parallel relation on opposite sides of the chassis 22. The longitudinal form of the side beams 76 and 78 has been particularly illustrated for the first side beam 76 in FIG. 4. The first side beam 76 comprises a first base beam 98 which extends along the bottom 34 of the chassis 22 from the rear cross beam 82 (not shown in FIG. 4) to the forward cross beam 84. A first vertical beam 100 is welded to the forward end 102 of the first base beam 98 and extends a short distance upwardly therefrom. A first sloping beam 104 is welded to the upper end 106 of the first vertical beam 100 and extends a preselected distance upwardly and forwardly along the first side 28 of the chassis 22. A first horizontal beam 108 is welded to the underside 110 (see FIG. 6) of the first sloping beam 104 at the upper end 112 of the first sloping beam 104 and extends therefrom to the forward end 88 of the first side beam 76. The second side beam 78 similarly comprises a second base beam 114 (FIGS. 2 and 3), a second vertical beam 116 (FIG. 6), a second sloping beam 118 (FIGS. 3 and 6) and a second horizontal beam 120 (FIGS. 2 and 3) which are interconnected in the same manner as the beams 98, 100, 104 and 108 such that the second side beam 78 mirrors the first side beam 76.

The power assembly 68 is mounted on the base beams 98 and 114 within a casing 122 disposed on a rear portion of the frame 74 of the chassis 22 and extending approximately from the rear cross beam 82 to the forward cross beam 84. The chassis 22 comprises a first side wall 124 (FIG. 1) and a second side wall 126 (FIG. 2) disposed forwardly of the casing 122 on the frame 74. An interior face 128 of the first side wall 124 is welded to the first base beam 98, the first vertical beam 100, the first sloping beam 104 and the first horizontal beam 108 and the first side wall 124 extends vertically along the first side 28 of the chassis 22 from the bottom 34 of the chassis 22 to the top 32 thereof as is particularly shown in FIGS. 1 and 4. The second side wall 126, which differs from being a mirror image of the first side wall 124 in only one particular to be discussed below, is similarly welded to the second base beam 114, the second vertical beam 116, the second sloping beam 118, and the second horizontal beam 120 such that the side walls 124 and 126 laterally enclose a portion of the chassis 22 in a medial portion thereof.

Figure 4:
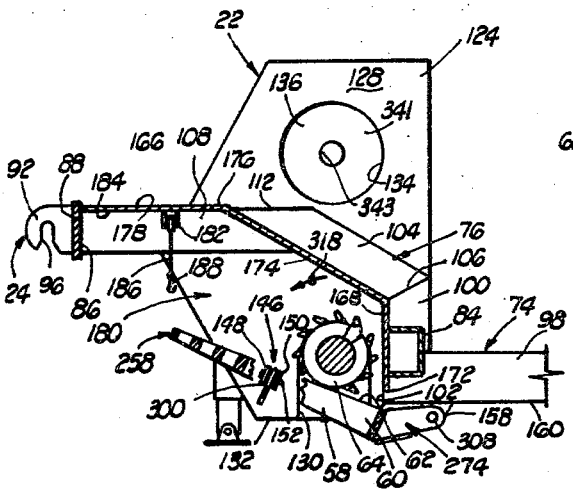
FIG. 4 is a cross-section in partial cutaway of a portion of the asphalt crushing apparatus of FIG. 1 taken substantially along line 4—4 of FIG. 3.
Figure 5:
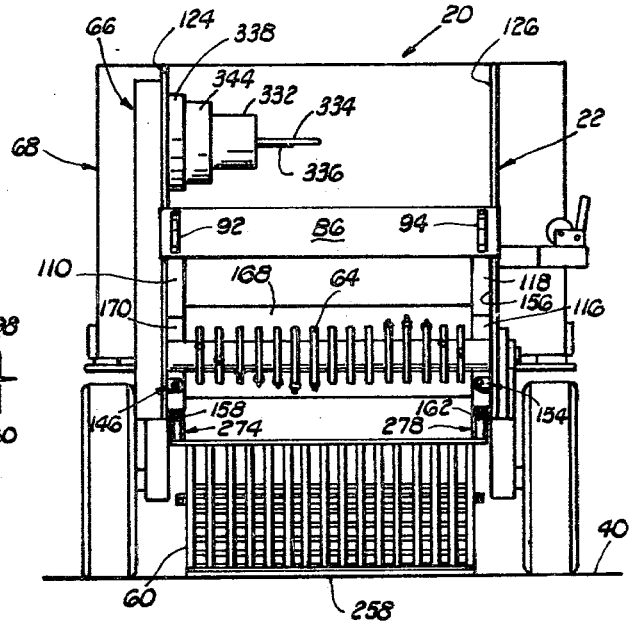

As is illustrated in FIG. 4, the first side wall 124 has a slot 130 formed in a lower portion thereof and the slot 130 intersects the lower edge 132 of the first side wall 124 and extends upwardly a distance therefrom. A circular aperture 134 is formed in an upper portion of the first side wall 124 above the slot 130. The second side wall 126 differs from being a mirror image of the first side wall 124 only in that the second side wall 126 is not provided with an aperture corresponding to the aperture 134. The purpose of the aperture 134 will be discussed below.

The second side wall 126 is provided with a slot (not shown) similar to the slot 130 and the slots formed in the lower portions of the side walls 124 and 126 provide the means for mounting the crushing tool 64 on the chassis 22. In particular, a first chassis side plate 136 is bolted to the exterior face 138 (FIG. 1) of the first side wall 124 over the slot 130 and the first chassis side plate 136 is provided with an aperture (not shown) and a bearing (not shown) for rotatably receiving a portion of the crushing tool 64 as will be described below. The first chassis side plate 136 extends upwardly of the slot 130 to overlay the aperture 134 in the assembled asphalt crushing apparatus 20 for a purpose to be described below. Similarly, a second chassis side plate 140 is bolted to the exterior face 142 (see FIG. 2) of the second side wall 126 and the second chassis side plate 140 is similarly provided with an aperture (not shown) and a bearing 144 for rotatably receiving a portion of the crushing tool 64. The second chassis side plate 140 terminates a short distance above the slot (not shown) formed in the lower portion of the second side wall 126.

Referring specifically to FIGS. 4 and 6, a chassis clevis 146 is mounted on the interior face 128 of the first side wall 124 for receiving a portion of the grid 60 such that the grid 60 can be mounted on the chassis 22. (A portion of the grid 60 has been cut away in FIG. 4 to illustrate the construction of the chassis clevis 146.) The chassis clevis 146 is constructed of a pair of apertured, parallel plates 148 and 150 in the usual manner and a pin 152 is insertable through the chassis clevis 146 to secure the grid 60 to the chassis clevis 146. A similar chassis clevis 154 (FIG. 6) is mounted on the interior face 156 of the second side wall 126. An apertured grid connection lug 158 is attached to the underside 160 of the first base beam 98 near the forward end 102 thereof and a similar grid connection lug 162 (FIG. 2) is similarly positioned on the underside 164 of the second base beam 114. As will be described more fully below, the chassis clevises 146 and 154 and the grid connection lugs 158 and 162 support the grid 60 on the chassis 22 such that, in a raised position of the grid 60 shown in FIGS. 1, 2 and 4, the grid 60 extends transversely across the chassis 22 adjacent the bottom 34 thereof between the side walls 124 and 126 and the grid 60 is positioned on a downward slant toward the rear end 26 of the chassis 22 as has been previously noted.

The chassis further comprises a cover plate 166 shown in cross-section in FIG. 4. The cover plate 166 comprises a lower portion 168 which is welded to the first vertical beam 100 adjacent the forward side 170 (see FIG. 6) thereof and which extends transversely across the chassis 22 to the second vertical beam 116 to which the lower portion 168 of the cover plate 166 is similarly welded. The lower portion 168 of the cover plate 166 is welded to the forward cross beam 84 and the lower portion 168 of the cover plate 166 terminates at a lower edge 172 which is positioned a short distance from the upper surface 62 of the gird 60 in the raised portion of the grid 60.

A medial portion 174 of the cover plate 166 is welded to the lower portion 168 thereof and to the first sloping beam 108 near the underside 110 (see FIG. 6) of the sloping beam 108. The medial portion 174 of the cover plate 166 extends transversely across the chassis 22 to the second sloping beam 116 to which the medial portion 174 of the cover plate 166 is similarly welded. An upper portion 176 is disposed on the upper surface 178 of the first horizontal beam 108 and is welded to the first side wall 124, the medial portion 174 of the cover plate 166 and the first horizontal beam 108. The upper portion 176 of the cover plate 166 extends transversely across the chassis 22 and is similarly positioned atop the second horizontal beam 120. The upper portion 176 of the cover plate 166 is welded to the second side wall 126 and the second horizontal beam 120 in the same manner that the upper portion 176 of the cover plate 166 is welded to the first side wall 124 and a first horizontal beam 108. The cover plate 166 coacts with the side walls 124 and 126 and with the grid 60 in the raised position of the grid 60 to form a crushing chamber 180 disposed near the forward end 24 of the chassis 22 and opening toward the forward end 24 of the chassis 22 such that the crushing chamber 180 opens toward the conveyor 56 of the roadway planer 44 in the towed mode of the asphalt crushing assembly 20.

Figure 3:
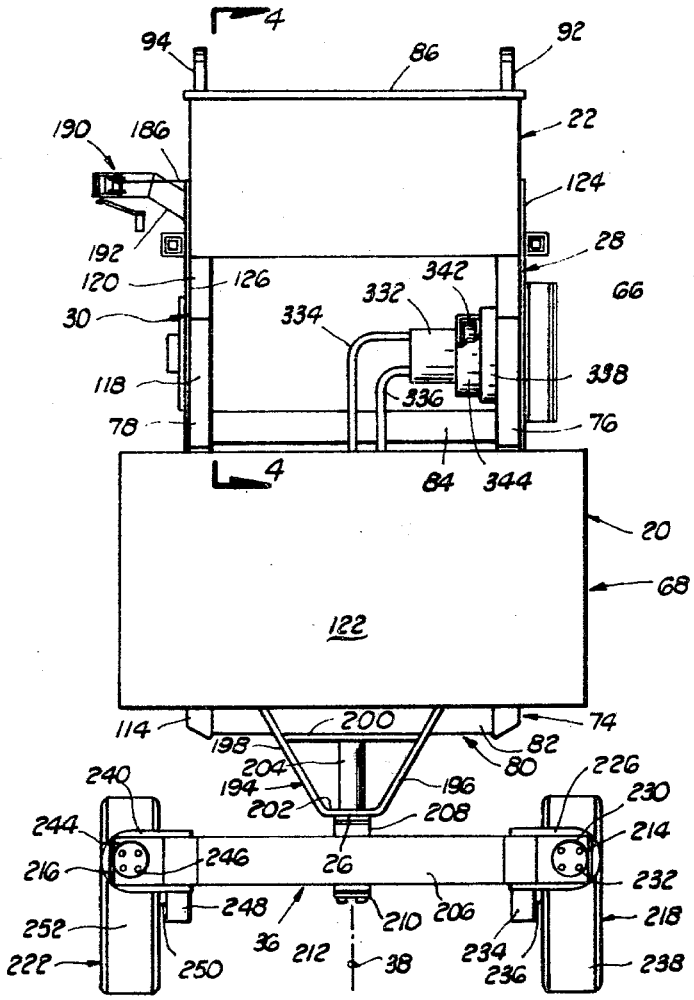
FIG. 3 is a plan view of the asphalt crushing apparatus of FIG. 1.
Figure 5:
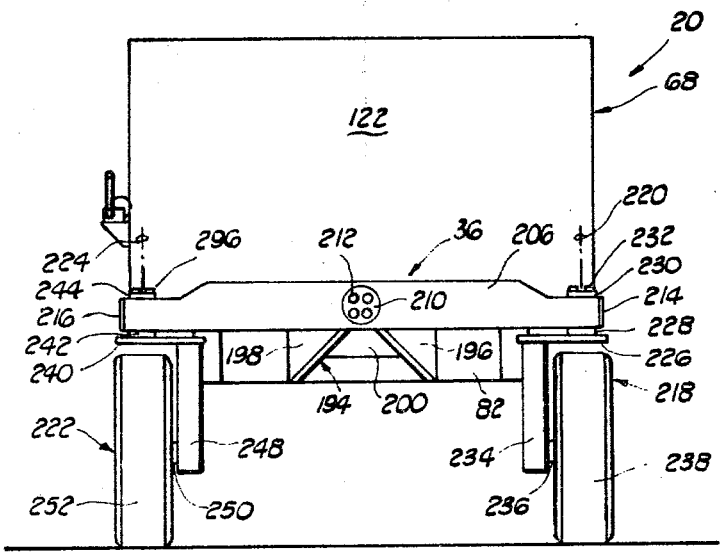
FIG. 5 is a rear elevational view of the asphalt crushing apparatus of FIG. 1.

A pulley 182 is mounted on the underside 184 of the upper portion 176 of the cover plate 166, in the usual manner, for rotation about a longitudinal axis of the asphalt crushing assembly 20 and a cable 186 passes over the pulley 182 to a hook 188 suspended above the grid 60. The cable 186 extends through an aperture (not shown) in the second horizontal beam 120 to a winch 190 mounted on a winch support 192 which is attached to the second side wall 126 as best seen in FIG. 3. The winch 190 is used to raise and lower the hook 188 for a purpose which will be described below.

Referring now to FIGS 1, 2, 3 and 5, the wheel assembly 36 is mounted on the chassis 22 via a wheel mount 194 disposed centrally on the rear cross beam 82 and extending therefrom to the rear end 26 of the chassis 22. The wheel mount 194 comprises a first wheel mount plate 196 disposed generally rear the first side 28 of the chassis 22 and a second wheel mount plate 198 disposed generally near the second side 30 of the chassis 22. The plates 196 and 198 are welded to the rear cross beam 82 and extend rearwardly thereof. The plates 196 and 198 converge towad the rear end 26 of the chassis 22. A forward brace plate 200 is welded to the rear cross beam 82 and to the wheel mount plates 196 and 198 and the forward brace plate 200 extends substantially vertically along the rear cross beam 82 between the wheel mount plates 196 and 198. A rear brace plate 202, disposed substantially parallel to the forward brace plate 200, connects the first wheel mount plate 196 to the second wheel mount plate 198 at the rear end 26 of the chassis 22. The rear brace plate 202 is provided with a circular aperture (not shown) and a pin 204, welded to the forward brace plate 200 and to the rear brace plate 202, passes through the aperture (not shown) in the rear brace plate 202 and extends rearwardly therefrom about the longitudinal axis 38 of the asphalt crushing assembly 20. The pin 204 extends substantially perpendicularly to the brace plates 200 and 202 such that the axis 38 extends along the direction of travel 46 of the roadway planer 44.

The wheel assembly 36 comprises a walking beam 206 mounted in a central portion thereof on the pin 204 via suitable bearings 208. A cap plate 210, attached to the distal end of the pin 204 via suitable fasteners 212, secures the bearing 208 and, accordingly, the walking beam 206 to the pin 204 for pivotation about the longitudinal axis 38 of the chassis 22. (For clarity of illustration, only one fastener 212 has been so designated in the drawings.)

The walking beam 206 is an elongated box structure terminating at a first end 214, displaced generally toward the first side 28 of the chassis 22 from the pin 204, and a second end 216, displaced generally toward the second side 30 of the chassis 22 from the pin 204. A first caster 218 is pivotally mounted on the walking beam 206 near the first end 214 thereof for rotation about a vertical axis 220 shown in FIG. 5. A second caster 222 is similarly pivotally mounted on the walking beam 206 near the second end 216 thereof for rotation about a vertical axis 224. The first caster 218 comprises a support plate 226 having a stub axle (not shown) disposed on one end thereof and extending upwardly through a bearing 228 mounted on the walking beam 206 near the first end 214 thereof. The stub axls (not shown) is pivotally secured to the walking beam via a cap plate 230 and suitable fasteners 232 in the same manner that the walking beam 206 is pivotally secured to the pin 204. (For clarity of illustration, only one of the fasteners 232 has been so designated in the drawings.) A strut 234 depends from the support plate 226 and a stub axle 236 is mounted on the strut 234 and extends therefrom generally parallel to the walking beam 206. A wheel 238 is mounted on the stub axle 236 in the usual manner. The second caster 222 is identical to the first caster 218, the second caster 222 comprising: a support plate 240; a stub axle (not shown) secured to the plate 240 and pivotally mounted via a bearing 242, a cap plate 244 and suitable fasteners 246 on the walking beam 206; a strut 248 depending from support plate 240; a stub axle 250 mounted on strut 248; and a wheel 252 mounted on the stub axle 250. (For clarity of illustration, only one of the fasteners 246 has been so designated in the drawings.)

Figure 7:
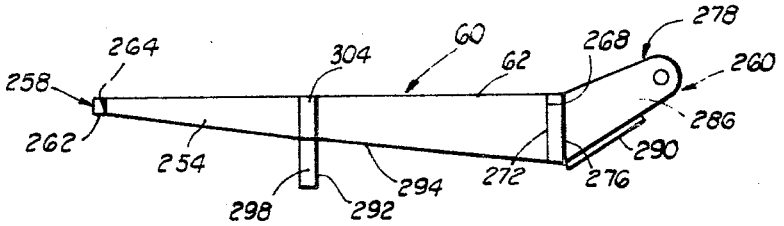
FIG. 7 is a side elevational view of the grid of the asphalt crushing apparatus of FIG. 1.
Figure 8:
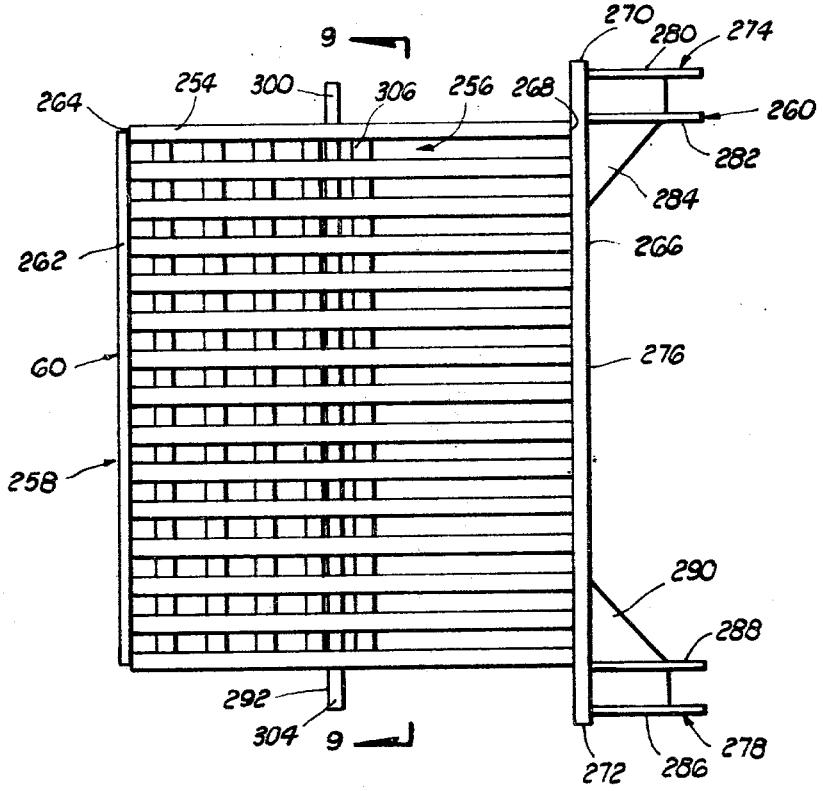
FIG. 8 is a plan view of the grid of FIG. 7.
Figure 9:
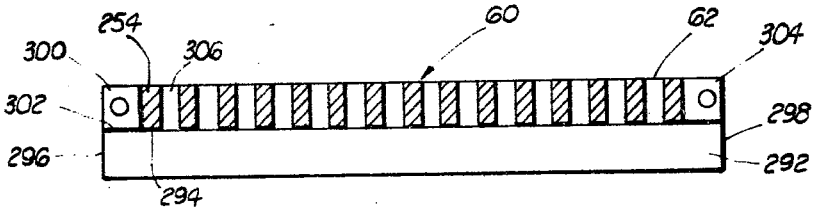
FIG. 9 is a cross-section of the grid of FIG. 7 taken substantially along line 9—9 of FIG. 8.

Referring now to FIGS. 7, 8 and 9, shown therein is the grid 60. The grid 60 comprises a plurality of hardened steel bars 254 which are disposed in a spaced apart, parallel relation such that a plurality of slots 256 are formed between adjacent bars 254. (For clarity of illustration, only one bar 254 and only one slot 256 have been provided with numerical designations in the drawings.) The bars 254 are spaced a preselected distance apart to define a predetermined dimension such that asphalt fragments deposited on the grid and having a size exceeding such dimension will be supported on the upper surface 62 of the grid 60. Smaller fragments will pass through the grid such that, when the grid 60 is mounted in the chassis 22 as shown in FIGS. 1, 2 and 4, such smaller fragments will be redeposited upon the roadway 40.

Each bar 254 is generally trapezoidal in shape, the bars 254 being narrower near the forward end 258 of the grid 60 than near a rear end 260 thereof as illustrated in FIG. 7. A transverse bar 262 is welded to the forward ends 264 of the bars 254 at the forward end 258 of the grid 60 and a transverse plate 266 is similarly welded to the rear ends 268 of the bars 254 near the rear end 260 of the grid 60 to form the grid 60 into a rigid structure. (The ends of only one bar 254 have been given numerical designations in the drawings.) The transverse plate 266 has a first end 270 displaced outwardly from the bars 254 on one side of the grid 60 and a second end 272 displaced outwardly from the bars 254 on the opposite side of the grid 60. A first grid clevis 274 is welded to the rear face 276 of the transverse plate 266 adjacent the first end 270 of the plate 266 and a second grid clevis 278 is similarly welded to the rear face 276 of the transverse plate 266 adjacent the second end 272 of the plate 266. The first grid clevis 274 comprises two spaced apart, apertured plates 280, 282 which are disposed perpendicularly to the plane of the upper surface 62 of the grid 60 and which extend generally upwardly and rearwardly from the transverse plate 266 with respect to the upper surface 62 of the grid 60. A brace 284 is welded to the first grid clevis 274 and to the transverse plate 266 to provide a firm support for the grid 60 at the rear end thereof on the chassis 22 when the grid 60 is mounted on the chassis 22 as will be described below. The second grid clevis 278 mirrors the first grid clevis 274, the second grid clevis similarly comprising two spaced apart apertured plates 286 and 288 and a brace 290.

A chassis connection plate 292 is welded to the undersides 294 of the bars 254 of the grid 60 in a medial portion of the grid 60. The chassis connection plate 292 extends transversely to the bars 254 and terminates in a first end 296, disposed on the same side of the grid 60 as the first grid clevis 274, and a second end 298, disposed on the same side of the grid 60 as the second grid clevis 278. An apertured first chassis connection lug 300 is welded to the upper surface 302 of the chassis connection plate 292 adjacent the first end 296 thereof and an apertured second chassis connection lug 304 is welded to the upper surface 302 of the chassis connection plate 292 adjacent the second end thereof. The chassis connection lugs 300, 304 are also welded to the outermost bars 254 of the grid 60 and extend transversely therefrom. As will be discussed below, the chassis connection lugs are utilized in conjunction with the grid clevises 274, 278 for mounting the grid 60 on the chassis 22.

As will be clear to those skilled in the art, it can be expected that an asphalt fragment having the form of a thin slab will occasionally be deposited on the grid 60 during the operation of the roadway planer 44 and the asphalt crushing apparatus 20 and that such a fragment can become aligned with the bars 254 to pass through the grid 60 even though the width of the slab is less than the preselected dimension separating the bars 254. To insure that such slabs will not pass through the grid 60 when the grid 60 is mounted on the chassis 22 as has been illustrated in FIGS. 1, 2 and 4, a plurality of interstitial blocks 306 are welded between adjacent bars in a forward portion of the grid 60 such that the forward portion of the grid 60 is provided with a sieve-like structure.

The manner in which the grid 60 is mounted on the chassis 22 in the raised position thereof is particularly illustrated in FIG. 4. The first grid clevis 274 is positioned to accept the grid connection lug 158 attached to the underside 160 of the first base beam 98 and a pin 308 is inserted through the apertures in the grid connection lug 158 to pivotally secure the first grid clevis 274 to the grid connection lug 158. Similarly, the grid connection lug 162 (FIG. 2) attached to the underside 164 of the second base beam 114 fits into the second grid clevis 278 and is pivotally secured thereto via a pin 310.

The first chassis clevis 146 is positioned on the interior face 128 of the first side wall 124 to receive the first chassis connection lug 300 of the grid 60 when the grid 60 is placed in the raised position thereof illustrated in FIG. 4 and the pin 152 passes through the apertures in the first chassis clevis 146 and the first chassis connection lug 300 to secure the first chassis connection lug 300 to the first chassis clevis 146 in the usual manner. Similaly, the second chassis clevis 154 receives the second chassis connection lug 304 in the raised position of the grid 60 and the second chassis connection lug 304 is secured to the second chassis clevis 154 via a pin (not shown). The chassis clevises 146 and 154 are positioned on the first and second side walls 124 and 126 respectively and the grid clevises 274 and 278 are angled with respect to the upper surface 62 of the grid 60 such that, in the raised position of the grid 60, the upper surface 62 thereof will be angled downwardly toward the rear end 26 of the chassis 22 at an angle of approximately 20 degrees as has been previously noted.

The grid 60 can be placed in a lowered position, illustrated in FIG. 6, wherein the rear end 260 of the grid 60 is pivotally connected to the chassis 22 as described above and wherein the forward end 258 of the grid 60 rests on the roadway 40. The winch 190 is provided on the chassis 22 for alternatively placing the grid 60 in the raised and lowered positions. In particular, the grid 60 is placed in a lowered position thereof from the raised position thereof by engaging the forward end 258 of the grid 60 with the hook 188 attached to the end of the cable 186 connected to the winch 190 such that the forward end 258 of the grid 60 can be supported via the winch 190. The pins passing through the chassis clevises 146 and 154 can then be removed such that the winch 190 can be utilized to lower the grid 60 into the lowered position thereof. Similarly, the winch 190 is utilized to raise the grid 60 from the lowered position to the raised position after which pins inserted in the chassis clevises 146 and 154 secure the grid 60 in the raised position. The purpose of alternatively placing the grid 60 in the raised position and in the lowered position will be discussed below.

Figure 10:
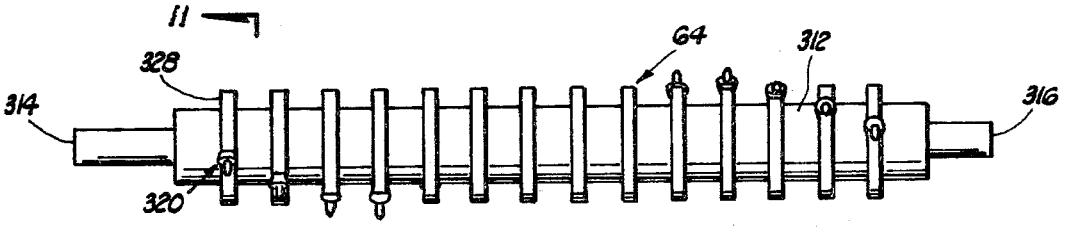
FIG. 10 is an elevational view of the crushing tool.
Figure 11:
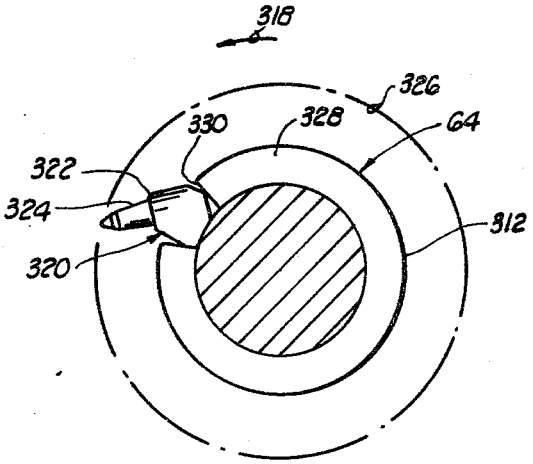
FIG. 11 is a cross-section of the crushing tool taken substantially along line 11—11 of FIG. 10.

The crushing tool 64 of the crusher assembly 58 is shown more particularly to FIGS. 4, 10 and 11. The crushing tool 64 comprises a cylindrical drum 312 having a first end 314 and a second end 316. A portion of the drum 312 adjacent the first end 314 thereof is formed on a reduced diameter and the reduced portion of the drum 312 adjacent the first end 314 thereof is supported for rotation about the axis of the drum 312 via the bearing (not shown) mounted on the first chassis side plate 136. Similarly, a portion of the drum 312 adjacent the second end 316 thereof is formed on a reduced diameter and the reduced portion of the drum 312 adjacent the second end 316 thereof is supported for rotation about the axis of the drum by the bearing 144 (FIG. 2) mounted on the second chassis side plate 140. Thus, the drum 312 is mounted on the chassis 22 via the chassis side plates 136 and 140 for rotation about an axis transverse to the ongitudinal axis 38 of the chassis 22. In an operational mode of the asphalt crushing apparatus 20, the drive assembly 66, to be described below, rotates the crushing tool 64 in the direction indicated by the arrows designated 318 in FIGS. 4 and 11.

The crushing tool 64 comprises a plurality of cutters 320 which are connected to the periphery of the drum 312. (For clarity of illustration, only one cutter 320 has been so designated in FIG. 10.) The cutters 320 are positioned on the drum 312 such that each cutter is aligned with a slot 256 between two adjacent bars 254 of the grid 60 when the crushing tool 64 is mounted on the chassis 22 and the cutters 320 are circumferentially displaced on the drum 312, one cutter 320 from another cutter 320, such that the cutters 320 are positioned along a spiral with respect to the drum 312.

Each cutter 320 compises a holder 322 welded to the drum 312 and a cutting bit 324 supported by the holder 322. In particular, the cutters 320 are constructed such that each cutting bit 324 is secured to a holder 322 via a spring clip (not shown), mounted on a shank (not shown) of the cutting bit 324 and disposed within a bore (not shown) of the holder 322, such that the cutting bit 324 can be extracted from the holder 322 via any suitable extracting tool.

The cutting bits 324 move along circular paths 326 when the drum 312 is rotated and the crushing tool 64 is mounted on the chassis 22 such that the cutting paths 326 intersect the grid 60 in the raised position of the grid 60. (For clarity of illustration, the cutting paths 326 have not been illustrated in FIG. 4.) Thus, in an operational mode of the asphalt crushing apparatus 20, each cutting bit 324 is repetitively moved in a slot 256 between adjacent bars 254 of the grid 60 to engage and crush asphalt fragments supported on the upper surface 62 of the grid 60.

A plurality of skirts 328 are welded to the periphery of the drum 312 and extend circumferentially about the drum 312. Each skirt 328 is axially aligned with one of the cutters 320 and an aperture 330 is formed in each skirt 328. The holder 322 of the cutter 320 aligned with each skirt 328 is disposed in the aperture 330 formed in the skirt 328. The skirts 328 provide standoff between the drum 312 and fragments of asphalt supported by the upper surface 62 of the grid 60 such that the cuttiing bits 324 will engage the asphalt fragments and reduce the size of the asphalt fragments prior to any engagement between the asphalt fragments and the holder 322 of the cutter 320.

Referring now to FIGS. 1, 3 and 6, shown therein is the drive assembly 66. With particular reference to FIG. 3, the drive assembly 66 comprises a hydraulic motor 332 supplied with pressurized hydraulic fluid from the power assembly 68 via hydraulic lines 334 and 336. The motor 332 drives a gear box 338 of conventional design and the gear box 338 has an output shaft 340 (FIG. 1) which delivers power to the crushing tool 64 as will be described below. A flywheel 342 is interposed between the motor 332 and the gear box 338 to smooth mechanical shock transmitted during the crushing of fragments of asphalt from the crushing tool 64 to the gear box 338. (A portion of the casing 344 of the flywheel 342 has been cut away in FIG. 3 to illustrate the placement of the flywheel 342.)

The motor 332, the gear box 338 and the flywheel 342 are supported on the chassis 22 via mounting of the gear box 338 on the first chassis side plate 136. The aperture 134 in the first side wall 124 permits the motor 332, the gear box 338 and the flywheel 342 to be mounted on an interior face 341 of the first chassis side plate 136 such that the motor 332, the gear box 338 and the flywheel 342 are disposed within the interior of the chassis 22 above the cover plate 166. The output shaft 340 of the gear box 338 passes through an aperture 343 formed in the first chassis side plate 136 to the exterior of the chassis 22.

Referring specifically to FIG. 1, a sprocket 346 is mounted on the distal end of the output shaft 340 of the gear box 338 and a similar sprocket 348 is mounted on the reduced portion of the drum 312 of the crushing tool 64 adjacent the first end 314 thereof. A chain 350, passing around the sprockets 346 and 348 in the usual manner, mechanically couples the hydraulic motor 332 and the gear box 338 to the crushing tool 64. A shroud 352 is disposed about the sprockets 346 and 348 and about the chain 350.

Operation of FIGS. 1 Through 11

Prior to the operation of the asphalt crushing apparatus 20, the asphalt crushing apparatus 20 is placed in the towed mode thereof by connecting the chassis lugs 92 and 94 to the roadway planer clevises on the rear end 42 of the roadway planer 44 as has been previously described. The legs 70 and 72 on the sides 28 and 30 of the asphalt crushing apparatus 20 are retracted, as illustrated for the leg 70 in FIG. 1. The grid 60 is placed in the raised position thereof via the winch 190 and the grid 60 is secured in the raised position via the chassis clevises 146 and 154 and via the chassis connection lugs 300 and 302 on the grid 60. The power assembly 68 is placed in an operating state such that the power assembly 68 rotates the crushing tool 64 via the drive assembly 66. That is, the power assembly provides hydraulic fluid to the hydraulic motor 332 to drive the gear box 338. The gear box 338 rotates the sprocket 346 on the output shaft 340 to rotate the sprocket 348 on the first end 314 of the drum 312 of the cutting tool 64 via the chain 350. Thus, the asphalt crushing assembly 20 is an operational mode wherein the cutting bits on the crushing tool 64 repetitively move between adjacent bars 254 of the grid 60.

With the asphalt crushing assembly in the operational mode and in the towed mode, the roadway planer 44 is driven along the roadway 40 in the direction 46. Roadway planing operations are then commenced with the roadway planer 44 as has been described in the aforementioned, co-pending U.S. patent application, Ser. No. 672,326. Asphalt removed from the roadway 40 is discharged at the rear end 42 of the roadway planer 44 via the conveyor 56 and such fragments are introduced onto the upper surface 62 of the grid 60. Fragments which are smaller than the predetermined dimension defined by the spacing of the bars 254 in the grid 60 fall through the grid 60 and are redeposited upon the roadway 40. Larger fragments are supported by the grid 60 and gravitate rearwardly and downwardly along the upper surface 62 thereof to the crushing tool 64. The larger fragments engage the skirts 328 on the crushing tool 64 such that the larger fragments are positioned in an intersecting relationship with the cutting bits 324 as the cutting bits 324 are driven along the circular paths 326. The cutting bits 324 engage the fragments of asphalt and cut away pieces thereof which are small enough to pass through the grid 60. Accordingly, the large fragments of asphalt are cut into small fragments which pass through the grid and which are redeposited upon the roadway 40.

As has been described in the aforementioned, copending U.S. patent application, Ser. No. 672,326, the roadway planer 44 is provided with cross slope controls; that is, with controls which maintain the surface of the roadway 40 resulting from the planing operation substantially level transversely to the direction 46 in which the roadway planer 44 and the asphalt crushing apparatus 20 move. The two point connection of the asphalt crushing apparatus 20 to the roadway planer 44 via the chassis lugs 92 and 94 on the first and second sides 28 and 30 respectively, of the asphalt crushing apparatus 20, coupled with the provision for pivotation of the wheel assembly 36 about the axis 38 which extends along the direction 46 in which the roadway planer 44 and the asphalt crushing apparatus 20 move, causes the cross slope control of the roadway planer 44 to result in cross slope control of the asphalt crushing apparatus 20. Should the deposition of asphalt on the roadway 40 become uneven transversely to the direction 46; that is, transversely to the longitudinal axis 38 about which the walking beam 206 pivots, the wheel assembly 36 will pivot on the pin 204 to maintain support at the rear end 26 of the chassis 22 by both wheels 238 and 252 of the wheel assembly 36 while the asphalt crushing apparatus 20 remains transversely parallel with the roadway planer 44.

As will be clear to those skilled in the art, the cutting bits 324 of the crushing tool 64 will become worn during the use of the asphalt crushing apparatus 20. When the cutting bits 324 have become worn to the extent that the reduction of the size of asphalt fragments is inefficient, the cutting bits 324 are replaced as will now be described. The roadway planer 44 is halted and the grid 60 is placed in the lowered position thereof in the manner previously described such that free access is provided to the crushing tool 64 from the forward end 24 of the chassis 22. A workman enters the chassis 22 from the forward end 24 thereof and removes worn cutting bits 324 with a suitable extracting tool. The worn cutting bits 324 are then replaced with new cutting bits 324. After the worn cutting bits 324 have been replaced, the grid 60 is replaced in the raised position thereof and the planing and fragment reduction operations are resumed.

At the end of the planing and fragment crushing operation, the asphalt crushing apparatus 20 is towed to a storage area and the legs 70 and 72 mounted on the sides 28 and 30 thereof are extended to support the forward end 24 of the chassis 22 as illustrated in FIG. 2. The planer connection lugs 92 and 94 are then disengaged from the rear end 42 of the roadway planer 44 in the manner which has been previously described. The roadway planer 44 can then be removed to other locations.

Description of FIGS. 12 Through 18

Figure 12:
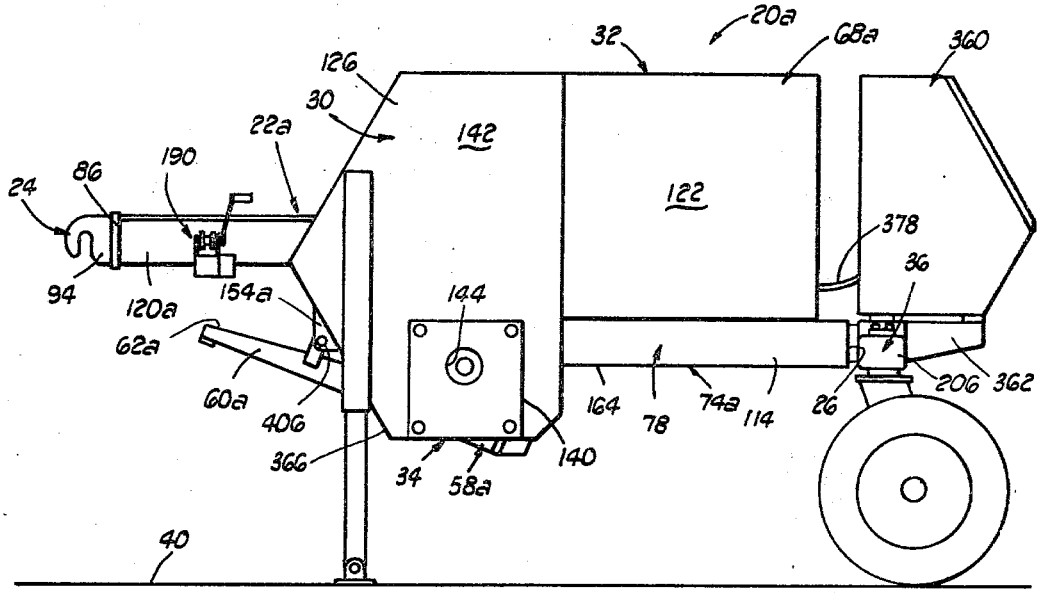
FIG. 12 is a side elevational view of a second embodiment of the asphalt crushing apparatus similar to FIG. 2.
Figure 13:
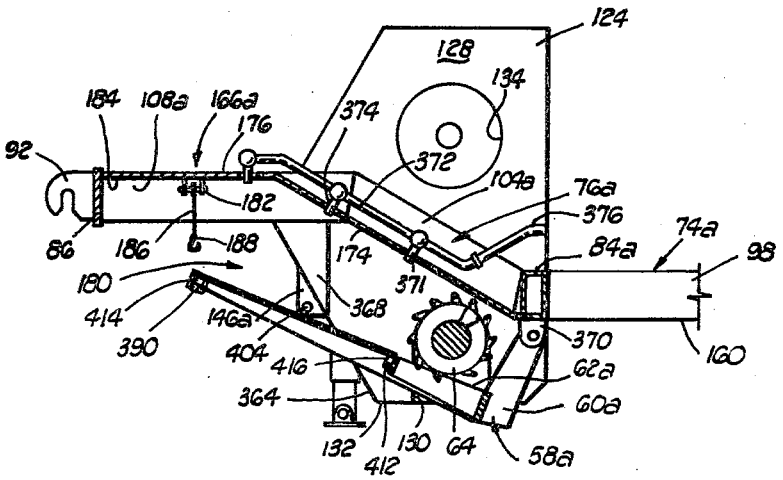
FIG. 13 is a cross-section of the asphalt crushing apparatus of FIG. 12 similar to FIG. 4.

Referring now to FIGS. 12 through 18 in general and to FIGS. 12 and 13 in particular, shown therein and designated by the general reference numeral 20*a* is a second embodiment of the asphalt crushing apparatus of the present invention. The asphalt crushing apparatus 20*a* is towed behind a roadway planer (not shown in FIGS. 12 through 18) in the same manner and for the same purpose that the asphalt crushing apparatus 20 is towed behind the roadway planer 44.

The asphalt cursching apparatus 20*a* generally comprises: a modified chassis 22*a* ; a wheel assembly 36 identical to the wheel assembly 36 of the asphalt crushing apparatus 20; a modified crusher assembly 58*a* ; a drive assembly (not shown) identical to the drive assembly 66 of the asphalt crushing apparatus 20; a modified power assembly 68*a* ; and a water tank 360 mounted on the wheel assembly 36. A support 362 is welded to the walking beam 206 of the wheel assembly 36 to provide means for mounting the water tank 360 on the wheel assembly 36. The power assembly 68*a* differs from the power assembly 68 in that the power assembly 68*a* includes a water pump (not shown) for discharging water in the water tank 360 for a purpose to be described below.

As in the case of the crusher assembly 58, the crusher assembly 58*a* comprises a grid, designated 60*a* and differing in construction from the grid 60 as will be described below with reference to FIGS. 14 through 18, and a crushing tool 64 which is identical to the crushing tool 64 of the crusher assembly 58. As is the case with the asphalt crushing apparatus 20, asphalt fragments are deposited on the upper surface 62*a* of the grid 60*a* by the conveyor of a roadway planer towing the asphalt crushing apparatus 20*a*. The upper surface 62*a* of the grid 60*a* is disposed on a front-to-rear, downward slope of approximately 20 degrees such that asphalt fragments deposited on the upper surface 62*a* of the grid 60*a* gravitate therealong to the crushing tool 64 for reduction into small fragments which pass through the grid 60*a* and are redeposited upon the roadway being planed by the roadway planer.

In the asphalt crushing apparatus 20*a*, the frame 74*a* of the chassis 22*a* is generally positioned at a greater height above a roadway 40 than is the case for the frame 74 of the chassis 22. In particular, the vertical beams 100 and 116 of the frame 74 are eliminated in the frame 74*a* such that the base beams 98 and 114 are shifted upwardly relative to the side walls 124 and 126. The raised location of the frame 74*a* permits the wheel mount 194 of the chassis 22 to be eliminated in the chassis 22*a*. That is, the wheel assembly 36 is directly mounted on the rear cross beam (not shown) of the chassis 22*a* rather than via a wheel mount 194. The wheel assembly 36 is pivotally connected to the rear cross beam (not shown) of the chassis 22*a* in the same manner that the wheel assembly 36 of the asphalt crushing apparatus 20 is connected to the wheel mount 194 of the asphalt crushing apparatus 20.

The asphalt crushing apparatus comprises two pairs of chassis clevises for mounting the grid 60*a* on the chassis 22*a*. In particular, the clevises 146 and 154 of the chassis 20 are replaced by corresponding first chassis clevises 146*a* and 154*a* which serve the same purpose in the apparatus 20*a* as that served by the clevises 146 and 154 in the apparatus 20. The first chassis clevises 146*a* and 154*a* are displaced forwardly of the positions occupied by the clevises 146 and 154 in the chassis 20 such that the first chassis clevises 146a and 154a extend from the leading edges, 364 and 366 respectively, of the first and second side walls 124 and 126. Clevis supports, having the general form of triangular boxes are welded to the interior faces of the side walls 124 and 126 to provide a means for supporting the first chassis clevises 146a and 154a on the side walls 124 and 126 respectively. (The clevis support on the interior face 128 of the first side wall 124 is shown in FIGS. 13 and designated 368 therein.) The clevises 146a and 154a are oriented to receive lugs which are generally parallel to the side walls 124 and 126 rather than lugs which are generally perpendicular to the side walls 124 and 126 as is the case with the clevises 146 and 154 of the apparatus 20. The grid connection lugs 158 and 162 of the chassis 22 are replaced by second chassis clevises in the chassis 22a. (One second chassis clevis, designated 370, is shown in FIG. 13.)

The cover plate 166a of the chassis 22a differs from the cover plate 166 in several respects. The lower portion 168 of the cover plate has been deleted in the cover plate 166a such that the crushing chamber 180 is open at both ends thereof. Moreover, a plurality of apertures 371 are formed in the medial portion 174 and the upper portion 176 of the cover plate 166a. (Only three of the apertures 371 have been shown in the drawings and, for clarity of illustration, only one aperture 371 has been so designated in the drawings.) A water spray assembly 372, having a plurality of standard spray nozzles 374 positioned in the apertures 371 is mounted on the cover plate 166a to spray water into the crushing chamber 180 during the operation of the asphalt crushing apparatus 20a to suppress dust. The spray assembly 372 is connected to the water pump (not shown) in the power assembly 68a via a conduit 376 and the water pump (not shown) is connected to the water tank 360 via a conduit 378 (see FIG. 12).

Figure 14:
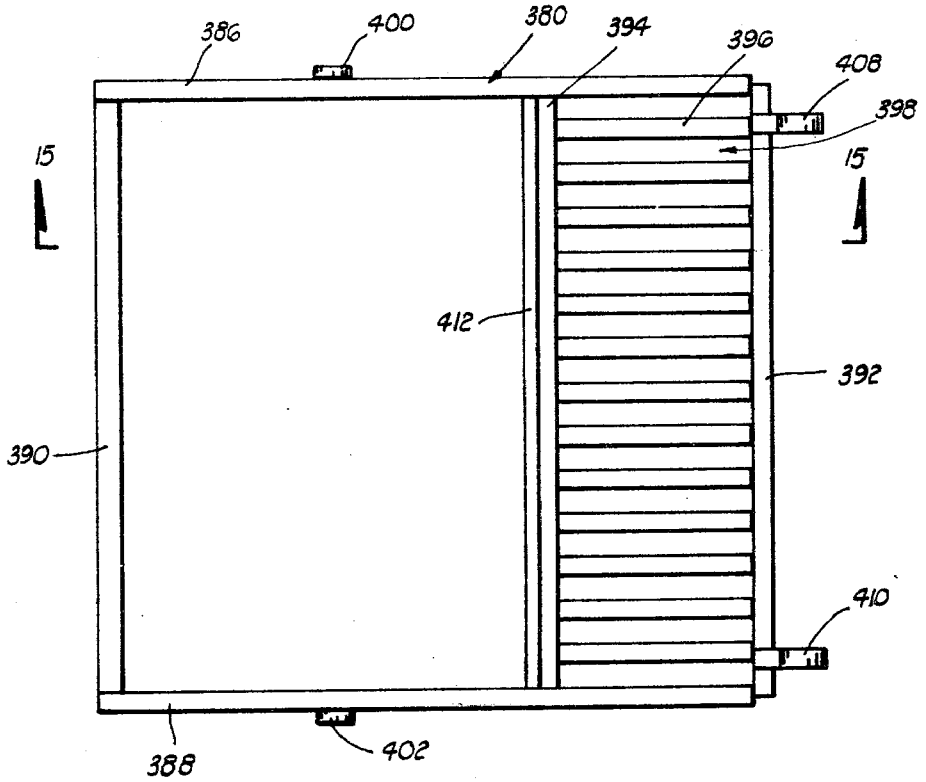
FIG. 14 is a plan view of the base member of the grid of the asphalt crushing apparatus of FIG. 12.
Figure 15:
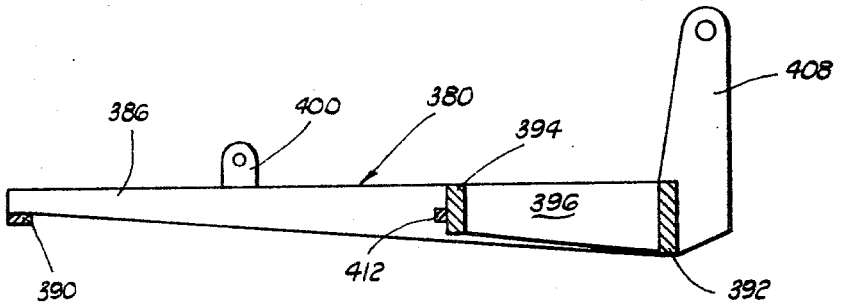
FIG. 15 is a cross section of the grid base member taken along line 15—15 of FIG. 14.
Figure 16:
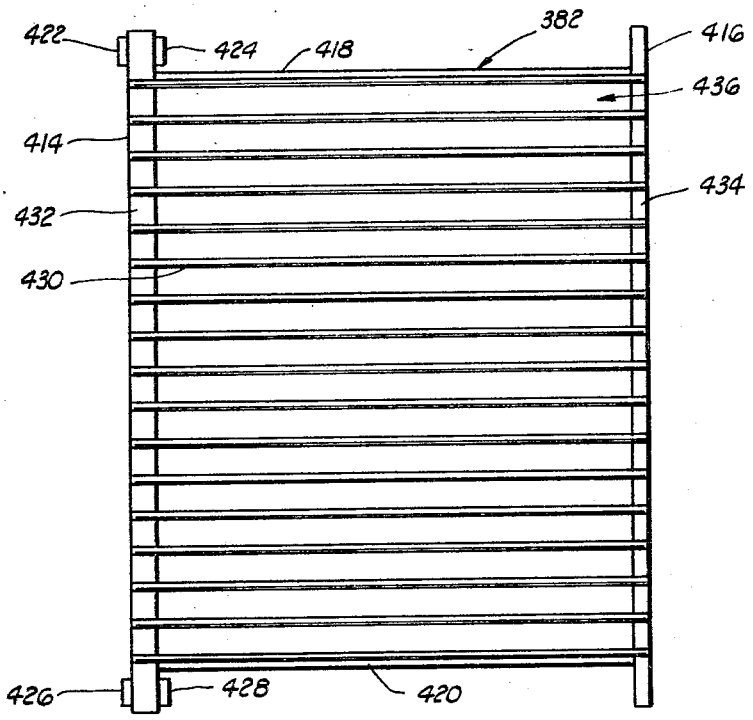
FIG. 16 is a plan view of one embodiment of the sieve member of the grid used with the apparatus of FIG. 12.
Figure 17:
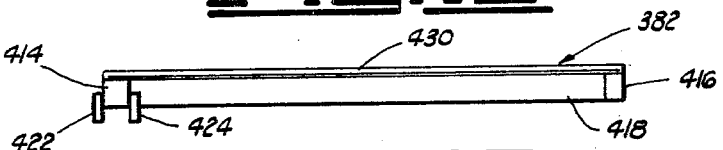
FIG. 17 is a side elevational view of the sieve member of FIG. 16.
Figure 18:
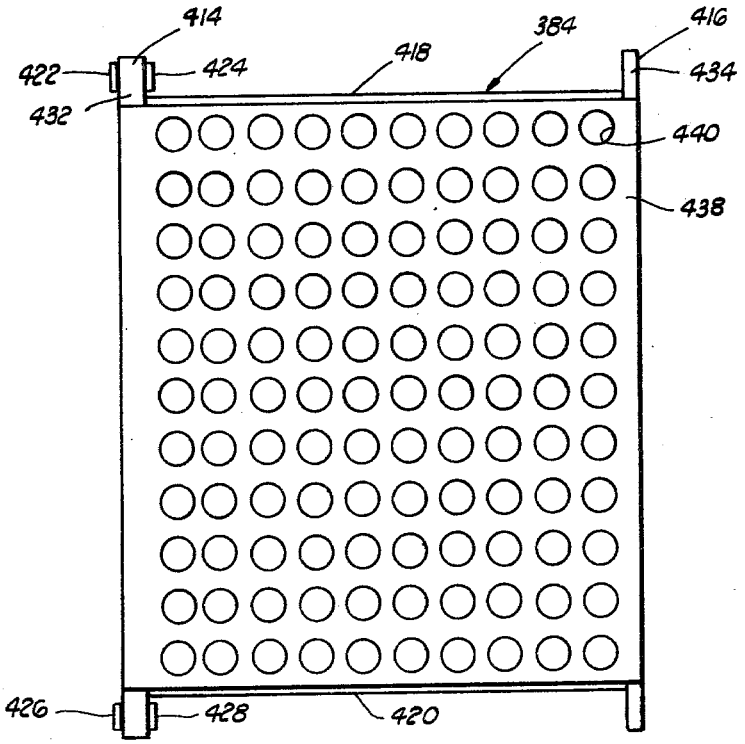
FIG. 18 is a plan view of a modification of the sieve member of the grid used with the apparatus of FIG. 12.

The grid 60a of the asphalt crushing apparatus 20a is formed in two parts: a base member 380, shown in FIGS. 14 and 15; and a sieve member. One form of the sieve member, designated 382, is shown in FIGS. 16 and 17 and a second form of the sieve member, designated 384, is shown in FIG. 18.

The base member 380 of the grid 60a comprises a first side bar 386 and a second side bar 388 disposed substantially parallel to the first side bar 386 and spaced a distance therefrom. Forward and rear cross bars, 390 and 392 respectively, extend between the side bars 386 and 388 such that the base member 380 has a generally rectangular form. An intermediate cross bar 394 extends between the side bars 386 and 388 in a medial portion of the base member 380 generally parallel to the cross bars 390 and 392. A plurality of slot forming bars 396, generally parallel to the side bars 386 and 388 are connected between the intermediate cross bar 394 and the rear cross bar 392. (For clarity of illustration, only one slot forming bar 396 has been so designated in the drawings.) The slot forming bars 396 form a plurality of slots 398 which permit the cutters 320 of the crushing tool 64 to move along paths which intersect the upper surface 62a of the grid 60a in the same manner that the paths of the cutters 320 intersect the upper surface 62 of the grid 60 in the asphalt crushing apparatus 20. (For clarity of illustration, only one slot 398 has been so designated.) That is, when the grid 60a is mounted on the chassis 22a and is disposed in the raised position shown in FIGS. 12 and 13, the slot forming bars 396 are interspersed among the cutting paths of the cutters 320.

A first forward grid lug 400 is welded to the first side bar 386 between the forward cross bar 390 and the intermediate cross bar 394 and a second forward grid lug 402 is similarly welded to the second side bar 388. The forward grid lugs 400 and 402 are inserted into the first chassis clevises 146a and 154a respectively and held therein via pins 404 and 406 (see FIGS. 12 and 13) to maintain the grid 60a in the raised position when the grid 60a is mounted on the chassis 22a. First and second rear grid lugs, 408 and 410 respectively, are welded to the rear cross bar 392 near the first side bar 386 and the second side bar 388 respectively and the rear grid lugs 408 and 410 mate with the second chassis clevises to pivotally support the rear end of the base member 380 on the chassis 22a in the same manner that the grid clevises 274 and 278 and the grid lugs 158 and 162 pivotally support the rear end of the grid 60 on the chassis 22. (See FIG. 13.)

The sieve member, 382 or 384, is mounted on the base member 380 between the side bars 386 and 388 and the sieve member 382 and 384 extends across the base member 380 between the side bars 386 and 388. Similarly, the sieve member 382 or 384, is disposed between the forward cross bar 390 and the intermediate cross bar 394 and extends between the forward cross bar 390 and the intermediate cross bar 394. As will be described below, the sieve member, 382 or 384, is supported by the forward cross bar 390 and a runner 412 welded along the intermediate cross bar 394 oppositely the slot forming bars 396. The runner 412 is substantially parallel to the cross bars 390, 392 and 394 and extends between the side bars 386 and 388.

As is the case with the base member 380, the sieve member 382 is a generally rectangular structure comprising: a forward end bar 414 which is disposed on the forward cross bar 390 in the assembled grid 60a as has been shown in FIG. 13; a rear end bar 416, which is disposed substantially parallel to the forward end bar 414 and is spaced therefrom a distance substantially equal to the spacing between the forward and intermediate cross bars, 390 and 394 respectively, of the base member 380 such that the rear end bar 416 is positioned on the runner 412 in the assembled grid 60a as has been shown in FIG. 13; a first longitudinal bar 418 extending between the end bars 414 and 416 on one side of the sieve member 382; and a second longitudinal bar 420 similarly extending between the end bars 414 and 416 on the opposite side of the sieve member 382. The longitudinal bars 418 and 420 are welded to the end bars 414 and 416 to form the sieve member 382 into a rigid structure.

The length of the forward end bar 414 is slightly shorter than the length of the forward cross bar 390 of the base member 380 and a pair of depending lugs 422 and 424 are welded to the sides of the forward end bar 414 near one end thereof to engage the sides of the forward cross bar 390 in the assembled grid 60a. Similarly, a pair of depending lugs 426 and 428 are welded to the sides of the forward end bar 414 near the opposite end thereof and the lugs 426 and 428 similarly engage the forward cross bar 390 in the assembled grid 60a. In the assembled grid 60a, the rear end bar 416 rests on the runner 412 of the base member 380 such that the sieve member 382 is supported by the forward cross bar 390 and the runner 412. The depending lugs 422, 424, 426 and 428 engage the forward cross bar 390 to position the sieve member 382 on the base member 380 in ths usual manner.

A plurality of rods 430 are welded to the upper surfaces, 432 and 434 respectively, of the forward end bar 414 and rear end bar 416 and extend therebetween substantially parallel to the first and second longitudinal bars 418 and 420 respectively. (For clarity of illustration, only one rod 430 has been so designated in the drawings.) The rods 430 are spaced to provide a plurality of openings 436 through the sieve member 382 such that fragments of asphalt exceeding a preselected dimension defined by the spacing of the rods 430 will be supported on the grid 60*a* and will gravitate therealong to the crushing tool 64 in the same manner that asphalt fragments gravitate along the grid 60 in the asphalt crushing apparatus 20. (For clarity of illustration, only one opening 436 has been so designated in the drawings.) Smaller fragments pass through the sieve member 380 and are redeposited upon the roadway 40.

The second form of the sieve member, shown in FIG. 18 and designated 384, differs from the sieve member 382 only in that the rods 430 are replaced by a plate 438. A plurality of apertures 440 are formed through the plate 438 such that asphalt fragments having a size exceeding a preselected dimension defined by the diameters of the apertures 440 are supported on the sieve member 384 and gravitate to the crushing tool 64 in the manner previously described. Smaller fragments pass through the apertures 440 and are redeposited upon the roadway 40.

It is clear that the present invention is well adapted to carry out the objects and obtain the ends and advantages mentioned as well as those inherent therein. While presently preferred embodiments of the invention have been described for purposes of this disclosure, numerous changes may be made which will readily suggest themselves to those skilled in the art and which are emcompassed within the spirit of the invention disclosed and as defined in the appended claims.

What is claimed is:

1. In combination with a roadway planer producing fragments of asphalt from a paved roadway and discharging the fragments from the rear end thereof a distance above the roadway:

a chassis connected to the rear end of the roadway planer;

wheel means supporting the chassis rearwardly of the planer; and crushing means carried by the chassis for receiving the fragments of asphalt from the roadway planer and reducing the size of the fragments exceeding a predetermined dimension, comprising:

a grid comprising a plurality of substantially parallel, spaced apart bars positioned to receive the fragments of asphalt thereon, the distance between the bars being substantially equal to said predetermined dimension;

a plurality of cutting bits sized to move between the bars; and means for repetitively moving the cutting bits between the bars for reducing the size of the fragments exceeding said predetermined dimension.

2. The combination of claim 1 wherein the grid further comprises a plurality of interstitial blocks disposed between adjacent bars in a portion of the grid.

3. The combination of claim 1 wherein the means for repetitively moving the cutting bits between the bars comprises a drum extending transversely to the bars of the grid, and means for rotating the drum.

4. The combination of claim 3 wherein the bars are aligned with the roadway planer and are supported on a slope with respect to the roadway such that the ends thereof nearest the roadway planer are higher than the opposite ends thereof.

5. The combination of claim 4 wherein the slope upon which the bars are disposed is substantially 20 degrees.

6. The combination of claim 4 characterized further to include a plurality of skirts extending circumferentially around the drum between the bars to retard the movement of fragments of asphalt along the bars, and wherein each skirt has an aperture therein in which one of said cutting bits is located.

7. The combination of claim 1 wherein the grid further comprises a sieve member adjacent one end of the bars and having a plurality of openings formed therethrough for discharging fragments smaller than said predetermined dimension and supporting fragments larger than said predetermined dimension.

8. The combination of claim 7 wherein the sieve member comprises a plurality of substantially parallel spaced apart bars such that openings in the sieve member are formed by spacings between the bars of the sieve.

9. The combination of claim 7 wherein the sieve member comprises a plate having a plurality of perforations such that the openings in the sieve member are formed by the perforations in the plate.

10. In combination with a roadway planer producing fragments of asphalt from a paved roadway and discharging the fragments from the rear end thereof a distance above the roadway:

a chassis connected to the rear end of the roadway planer, wherein the chassis is connected to the roadway planer by at least two transversely spaced lugs to remain transversely parallel with the roadway planer;

wheel means supporting the chassis rearwardly of the planer, wherein the wheel means includes a walking beam pivotally connected to the chassis for pivotation with respect to the chassis about a horizontal axis extending in the directional movement of the roadway planer, and a wheel connected to each end of the walking beam; and crushing means carried by the chassis for receiving the fragments of asphalt from the roadway planer and reducing the size of the fragments exceeding a predetermined dimension.

* * * * *